US012116182B2

(12) United States Patent
Ding et al.

(10) Patent No.: US 12,116,182 B2
(45) Date of Patent: Oct. 15, 2024

(54) PACKAGING BOX AND PAPERBOARD STRUCTURE

(71) Applicant: ShenZhen YUTO Packaging Technology Co., Ltd., Shenzhen (CN)

(72) Inventors: Zhiyong Ding, Shenzhen (CN); Junxiong Wu, Shenzhen (CN)

(73) Assignee: SHENZHEN YUTO PACKAGING TECHNOLOGY CO., LTD, Shenzhen (CN)

( * ) Notice: Subject to any disclaimer, the term of this patent is extended or adjusted under 35 U.S.C. 154(b) by 159 days.

(21) Appl. No.: 17/617,835

(22) PCT Filed: Aug. 13, 2021

(86) PCT No.: PCT/CN2021/112489
§ 371 (c)(1),
(2) Date: Dec. 9, 2021

(87) PCT Pub. No.: WO2023/010611
PCT Pub. Date: Feb. 9, 2023

(65) Prior Publication Data

US 2023/0036671 A1 Feb. 2, 2023

(30) Foreign Application Priority Data

Jul. 31, 2021 (CN) ..... 202121767679.9

(51) Int. Cl.
*B65D 5/50* (2006.01)

(52) U.S. Cl.
CPC ..... *B65D 5/5014* (2013.01)

(58) Field of Classification Search
CPC .... B65D 5/5014; B65D 5/5002; B65D 5/009; B65D 5/50; B65D 5/2009; B65D 5/2057; B65D 5/5016; B65D 5/5021
(Continued)

(56) References Cited

U.S. PATENT DOCUMENTS 3,693,865 A * 9/1972 Desmond ..... B65D 5/6626 229/224
4,144,996 A * 3/1979 Kuckenbecker ..... B65D 5/6626 229/173
(Continued)

FOREIGN PATENT DOCUMENTS

CN 106240988 A 12/2016
CN 208248724 U 12/2018
(Continued)

OTHER PUBLICATIONS

International Searching Authority, International Search Report for the application No. PCT/CN2021/112489, dated Apr. 21, 2022, 12 pages.

*Primary Examiner* — Christopher R Demeree
(74) *Attorney, Agent, or Firm* — Haverstock & Owens, A Law Corporation

(57) ABSTRACT

The present disclosure relates to a packaging box and a paperboard structure. The packaging box comprises a first packaging box body, an integral connecting portion, a second packaging box body and a switchable connecting portion which are connected end to end in sequence. The first packaging box body comprises a first accommodating portion formed by a first surface in a thickness direction of the first packaging box recessed inwardly. The second packaging box body comprises a second accommodating portion formed by a second surface in a thickness direction of the second packaging box recessed inwardly. A bendable connection is formed between the first packaging box body and the second packaging box body via the integral connecting portion and the switchable connecting portion, so that the first surface and the second surface are positioned to be opposite to each other.

8 Claims, 6 Drawing Sheets

(58) Field of Classification Search
USPC .... 229/120.08, 120.09, 117.17, 152, 120.18, 229/120.04, 121, 150, 194; 206/485, 588, 206/593
See application file for complete search history.

(56) References Cited

U.S. PATENT DOCUMENTS

| | | | | |
|---|---|---|---|---|
| 4,450,965 | A | 5/1984 | Paillet | |
| 5,529,187 | A * | 6/1996 | DeNola | B65D 85/38 206/707 |
| 5,884,767 | A * | 3/1999 | Peng | B65D 5/5253 206/320 |
| 6,474,473 | B2 * | 11/2002 | Wong | B65D 5/5021 206/427 |
| 7,624,876 | B1 * | 12/2009 | Green | B65D 75/322 206/764 |
| 10,913,567 | B2 * | 2/2021 | Nelson | B65D 5/002 |
| 2016/0159515 | A1 * | 6/2016 | Putko | B65D 5/2057 229/152 |
| 2021/0061513 | A1 * | 3/2021 | Kiefiuk | B65D 5/48002 |

FOREIGN PATENT DOCUMENTS

| | | | |
|---|---|---|---|
| CN | 211309242 | U | 8/2020 |
| CN | 211894032 | U | 11/2020 |
| EP | 0441102 | A1 | 8/1991 |
| KR | 101447422 | B1 | 10/2014 |

* cited by examiner

PACKAGING BOX AND PAPERBOARD STRUCTURE

CROSS REFERENCE

The present disclosure is a National Stage of International Application No. PCT/CN2021/112489, filed on Aug. 13, 2021, which claims priority to Chinese patent application No. 202121767679.9 filed on Jul. 31, 2021, titled "Packaging Box and Paperboard Structure", both of which are incorporated by reference in their entireties.

TECHNICAL FIELD

The present disclosure relates to the technical field of packaging, and in particular relates to a packaging box and paperboard structure.

BACKGROUND

Fast-moving consumer goods refer to consumer goods with a short service life and a fast consumption rate, such as razors, toothbrush heads, etc., which are consumed in huge amount all over the world and continue to be consumed year-round. At this time, traditional packaging boxes play an important role. One role is factory protection that is convenient for transportation, and another role is temporary storage that can make the goods to be displayed and taken out one by one during use. In order to pass tests such as drop and vibration, it is usually necessary for the traditional packaging box to be provided with an independent inner snapping structure (such as a paper tray) in the packaging box to position packaging items. Therefore, the traditional packaging box is relatively limited in product display, cannot fully display the product conveniently, and requires a high cost in order to ensure the performance of anti-drop, anti-vibration and the like.

SUMMARY

The present disclosure provides a packaging box and paperboard structure.

Therefore, in an aspect, an embodiment of the present disclosure provides a packaging box, comprising a first packaging box body, an integral connecting portion, a second packaging box body and a switchable connecting portion which are connected end to end in sequence; wherein the first packaging box body comprises a first accommodating portion formed by a first surface in a thickness direction of the first packaging box body recessed inwardly; the second packaging box body comprises a second accommodating portion formed by a second surface in a thickness direction of the second packaging box body recessed inwardly; and a bendable connection is formed between the first packaging box body and the second packaging box body via the integral connecting portion and the switchable connecting portion, so that the first surface and the second surface are positioned to be opposite to each other.

In another aspect, an embodiment of the present disclosure provides a paperboard structure comprising a first switchable connecting area, a first body area, an integral connecting area, and a second body area connected in sequence along a first direction. The first body area is used to form a first packaging box body, and comprises a first bottom area, a first top area, and a first sidewall area that connects the first bottom area and the first top area distributed along a second direction, and wherein the first top area is provided with a first accommodating opening;

The second body area is used to form a second packaging box body, and comprises a second bottom area, a second top area and a second sidewall area that connects the second bottom area and the second top area distributed along the second direction, and wherein the second top area is provided with a second accommodating opening.

The first switchable connecting area is used to connect the first body area and the second body area to form a packaging box.

The packaging box comprises the first packaging box body, the integral connecting area, the second packaging box body, and the first switchable connecting area that are connected end to end in sequence; wherein the first direction intersects the second direction.

It is to be understood that both the foregoing general description and the following detailed description are exemplary and explanatory only and are not restrictive of the present disclosure.

BRIEF DESCRIPTION OF THE DRAWINGS

In order to more clearly describe technical solutions in embodiments of the present disclosure or the prior art, drawings that need to be used in describing embodiments or the prior art will be briefly introduced in the following. Obviously, the drawings in the following description are only some embodiments of the present disclosure. For those of ordinary skill in the art, other drawings can be obtained based on these drawings without creative work.

DETAILED DESCRIPTION

Features and exemplary embodiments of each aspect of the present disclosure will be described in detail below. In order to make purposes, technical solutions, and advantages of the present disclosure clearer, the present disclosure will be further described in detail with reference to drawings and specific embodiments. It should be understood that specific embodiments described herein are only intended to explain, not to limit the disclosure. For those skilled in the art, the present disclosure can be implemented without some of these specific details. Description of following embodiments is only to provide a better understanding of the present disclosure by showing examples of the present disclosure.

It should be noted that in the text, relational terms, such as first and second, are only used to distinguish one entity or operation from another entity or operation, and do not necessarily require or imply any such actual relationship or order between these entities or operations. Moreover, the terms "include", "comprise" or any other variants thereof are intended to cover non-exclusive inclusion, so that a process, method, article or device including a series of elements not only includes said elements, but also includes those that are not explicitly listed, or also includes elements inherent to the process, method, article or device. If there are no more restrictions, the element defined by a sentence "including . . . " does not exclude existence of other same elements in the process, method, article or device that includes the element.

For fast-moving consumer goods, a demand for packaging boxes is huge. In the past, blister packaging was used. A large number of blister packaging boxes cause a waste of non-renewable petrochemical resources during a production process and cause great environmental pollution waste in a process of disposal. Because this kind of blister packaging is scattered and discarded and id extremely difficult to be recycled, it cannot be degraded in a natural environment for decades, which greatly damages environmental protection. Paper card materials are a new kind of paper-card paper that is beneficial to environmental protection, and it has a characteristics of low cost, strong confidentiality, environmental protection and energy saving. However, packaging boxes made of paper card materials are often complex in structure and cannot be easily opened and closed to partially or completely display products, can only meet a need of a single product, and is not suitable for large-scale promotion and use. In addition, a packaging box made of paper card materials needs to be additionally equipped with a separate inner snapping structure to position a product, which requires a relatively high cost.

Figure 1:
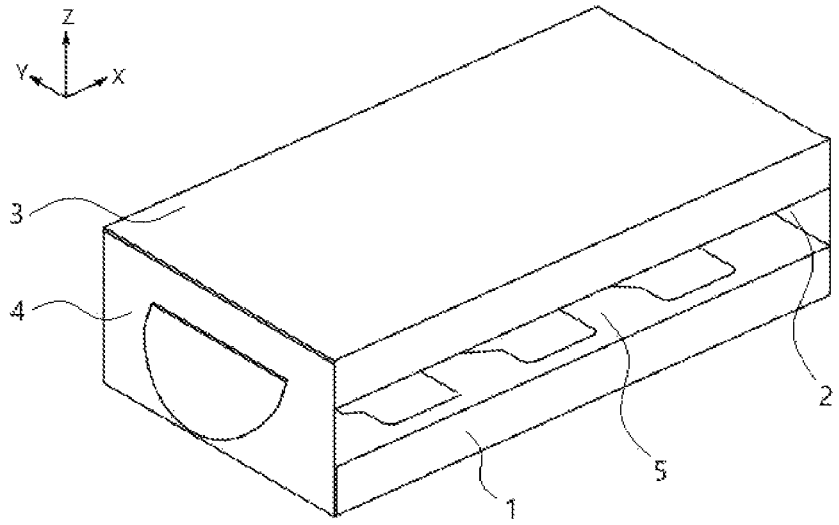
FIG. 1 is a schematic structural diagram of a packaging box provided by an embodiment of the present disclosure.
Figure 2:
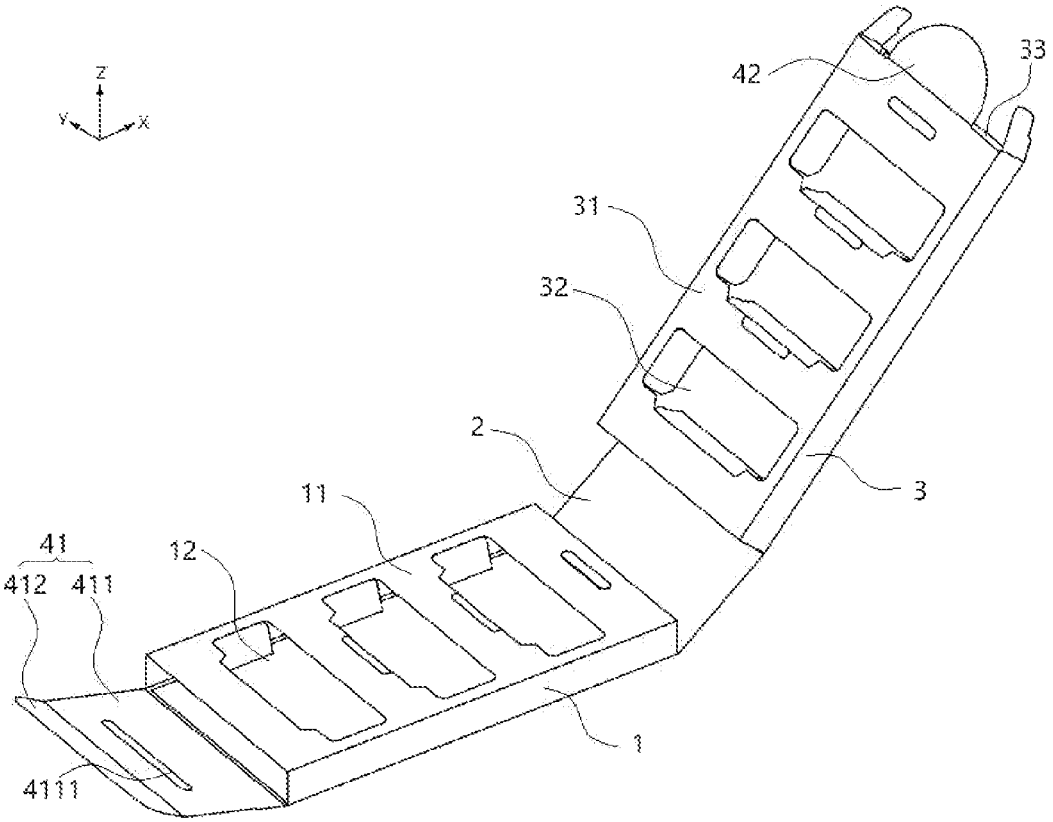
FIG. 2 is a schematic structural diagram of the packaging box shown in FIG. 1 in an open state.

To solve the above problems, the present disclosure proposes a packaging box and paperboard structure. Please refer to FIG. 1 and FIG. 2. FIG. 1 is a schematic structural diagram of a packaging box provided by an embodiment of the present disclosure. FIG. 2 is a schematic structural diagram of the packaging box shown in FIG. 1 in an open state.

A packaging box proposed in the present disclosure includes a first packaging box body 1, an integral connecting portion 2, a second packaging box body 3, and a switchable connecting portion 4 that are connected end to end in sequence. The first packaging box body 1 includes a first accommodating portion 12 formed by a first surface 11 in a thickness direction of the first packaging box body recessed inwardly, and the second packaging box body 3 includes second accommodating portion 32 formed by a second surface 31 in a thickness direction of the second accommodating portion recessed inwardly. A bendable connection is formed between the first packaging box body 1 and the second packaging box body 3 via the integral connecting portion 2 and the switchable connecting portion 4, so that the first surface 11 and the second surface 31 is positioned opposite to each other.

The first packaging box body 1 and the second packaging box body 3 both are in spatial three-dimensional structures, and the integral connecting portion 2 and the switchable connecting portion 4 are respectively located on different sides of the first packaging box body 1 in an extension direction of the first packaging box, and are respectively connected to two sides of the second packaging box body 3. The integral connecting portion 2 is in an integral structure, and its ends are respectively bendably connected to the first packaging box body 1 and the second packaging box body 3. A positional relationship between the first packaging box body 1 and the second packaging box body 3 can be changed by an adjustment of a bending angle between the integral connecting portion 2 and the first packaging box body 1 and a bending angle between the integral connecting portion 2 and the second packaging box body 3. The switchable connecting portion 4 is connected to the other side of the first packaging box body 1 and the second packaging box body 3 to realize a position fixation between the first packaging box body 1 and the second packaging box body 3. Shapes of the first packaging box body 1 and the second packaging box body 3 are not limited. In an example, the first packaging box body 1 and the second packaging box body 3 are both in rectangular parallelepiped structures, and their outline dimensions are the same.

The switchable connecting portion 4 is used to control an opening and closing of the packaging box, and a product can be put in and taken out by a plug-in and plug-out of the switchable connection part 4, which is convenient and quick to operate. Moreover, when the packaging box is open, a bending angle between the first packaging box body 1 and the second packaging box body 3 can be adjusted via the integral connecting portion 2 so that the product can be partially or completely displayed according to requirements. The first accommodating portion 12 and the second accommodating portion 32 are used for accommodating products. Sizes of the first accommodating portion 12 and the second accommodating portion 32 can be customized according to an actual product shape, so as to meet different needs and have strong versatility. During use, the first packaging box body 1 and the second packaging box body 3 are stacked in a third direction Z, and the first accommodating portion 12 and the second accommodating portion 32 are used for accommodating products. That is, the products are located within the first packaging box body 1 and the second packaging box body 3, the first packaging box body 1 and the second packaging box body 3 play a role in supporting and protecting the products, and there is no need to provide an additional inner snapping structure, thereby reducing packaging costs to a certain extent.

The embodiment of the present disclosure provides the packaging box. The first packaging box body and the second packaging box body are stacked in the third direction, and form the first accommodating portion and the second accommodating portion along the thickness direction of the packaging box for accommodating products to support and protect the products during mobile transportation without additional inner snapping structure, and the overall structure is stable and reliable. And according to different actual situations, the first accommodating portion and the second accommodating part can be designed into different shapes and sizes, so as to carry products of different sizes to use different types of products. In addition, the bendable connection is formed between the first packaging box body and the second packaging box body via the integral connecting portion and the switchable connecting portion, and the opening and closing of the packaging box can be realized by a plug-in and plug-out of the switchable connecting portion during use, which is convenient for the product to be put in and taken out to be partially or completely displayed.

In some embodiments, the first surface and the second surface are opposite to each other and separated by a predetermined distance.

In some embodiments, there may be multiple first accommodating portions and second accommodating portions, and multiple first accommodating portions and multiple second accommodating portions are provided in one-to-one correspondence.

In an embodiment of the present disclosure, the first packaging box body 1, the second packaging box body 3, the integral connecting portion 2, and the switchable connecting portion 4 are connected end to end to form a ring structure, and surround to form an opening space 5. The opening space 5 is respectively communicated with the first accommodating portion 12 and the second accommodating portion 32, and the ring structure makes the structure of the packaging box stable and reliable, and can bear a certain pressure. Optionally, the first accommodating portion 12 and the second accommodating portion 32 are arranged correspondingly. That is, in the third direction Z, the first accommodating portion 12, the second accommodating portion 32, and the opening space 5 together constitute a continuous space. For a large-sized product, a single product can be placed in the first accommodating portion 12, the second accommodating portion 32 and the opening space 5 at the same time. For a medium-sized product, a single product can be placed in the first accommodating portion 12 and the opening space 5 at the same time, or the second accommodating portion 32 and the opening space 5. For a small-sized product, the product can be completely placed in the first accommodating portion 12 or the second accommodating portion 32. The size of the opening space 5 is determined by the predetermined distance between the first surface 11 and the second surface 31. It can be understood that when the product size is less than a specific value, the opening space 5 can also be cancelled. That is, the predetermined distance between the first surface 11 and the second surface 31 is 0, the first packaging box body 1 and second packaging box body 3 completely contact with each other, and the overall structure of the packaging box is more compact.

As shown in FIG. 1, both the first accommodating portions 12 and the second accommodating portions 32 are respectively arranged in an array along a first direction X. Multiple first accommodating portions 12 are communicated with each other inside the first packaging box body 1, and multiple second accommodating portions 32 are communicated with each other inside the second packaging box body 3. The number of the first accommodating portions 12 and the number of the second accommodating portions 32 are determined according to an actual use situation. The multiple first accommodating portions 12 can be of the same shape and used to carry the same product, or can also be of different shapes and used to carry different products, and are not limited in the present disclosure.

In some embodiments, please continue to refer to FIG. 1 and FIG. 2, an end of the second packaging box body 3 close to the switchable connecting portion 4 is provided with a first slot 33. The switchable connecting portion 4 includes a first part 41 connected to the first packaging box body 1, and the first part 41 includes a transition portion 411 and a first switchable portion 412. The first switchable portion 412 is bendably connected to the first packaging box body 1 via the transition portion 411, and is connected to the first slot 33 in a pluggable manner.

The integral connecting portion 2 is used to connect the first packaging box body 1 and the second packaging box body 3, and the switchable connecting portion 4 is used to fix a relative position between the first packaging box body 1 and the second packaging box body 3. The first part 41 of the switchable connecting portion 4 is connected to a surface of the first packaging box body 1 opposite to the first surface 11. The transition portion 411 can be bendably connected to the first packaging box body 1. The first switchable portion 412 can be bent relative to the transition portion 411. The first switchable portion 412 and the first slot 33 can fit with each other to be fixed. The bent transition portion 411 and the integral connecting portion 2 may be parallel to each other, and their heights are the same. Optionally, a height dimension of the bent transition portion 411 is greater than a sum of thicknesses of the first packaging box body 1 and the second packaging box body 3, so that the first packaging box body 1 and the second packaging box body 3 are spaced apart to increase storage space for products.

In an embodiment, the switchable connecting portion 4 may further include a second part 42 connected to the second packaging box body 3. The second part 42 is provided on the second surface 31, the transition portion 411 is provided with a second slot 4111, and the second part 42 is connected to the second slot 4111 in a pluggable manner.

The second part 42 has a tongue structure, is located at an edge of a side of the second surface 31 close to the switchable connecting portion 4, and protrudes outward along an extension direction of the second packaging box body 3. The second part 42 can be bent relative to the second surface 31. The second slot 4111 has a through slot structure and is arranged to fit with the second part 42. During use, the first switchable portion 412 is firstly inserted into the first slot 33, then the second part 42 is inserted completely into and across the second slot 4111, and the first switchable portion 412 is completely inserted into the first slot 33 to realize a first fixation. Finally, the second part 42 is bent to contact a surface of the transition portion 411 to realize a second fixation.

In the embodiment of the present disclosure, a double fixation between the first packaging box body 1 and the second packaging box body 3 is realized via both a fit of the first switchable portion 412 with the first slot 33 and a fit of the second part 42 with the second slot 4111. Therefore, the structure as a whole is stable and reliable, and tests of drop and vibration can be met. In addition, when the product needs to be taken out, only the fit of the first switchable portion 412 with the first slot 33 needs to be released, and the packaging box can be opened. The operation is simple and convenient, it is convenient for storage and use, and practicability is strong.

Figure 3:
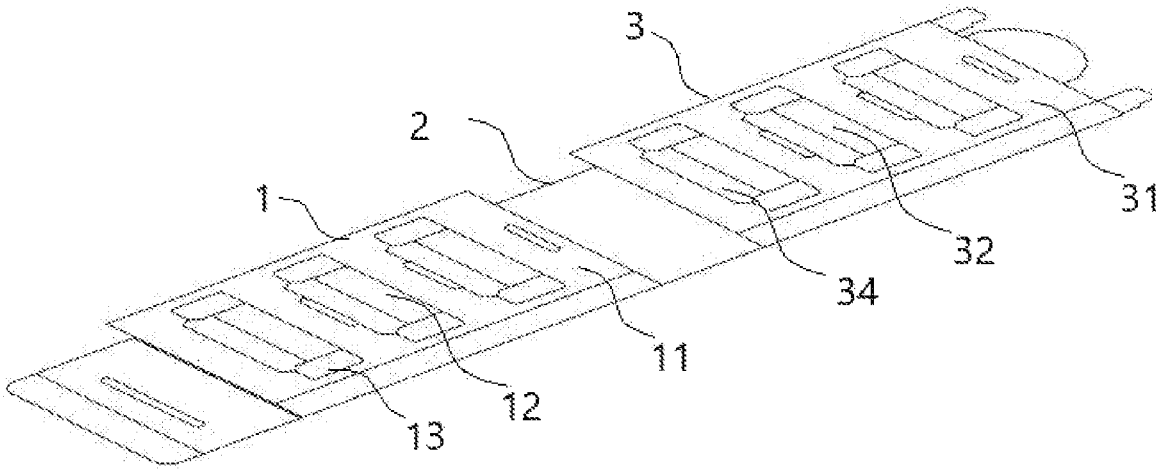
FIG. 3 is a schematic structural diagram of another packaging box provided by an embodiment of the present disclosure.
Figure 4:
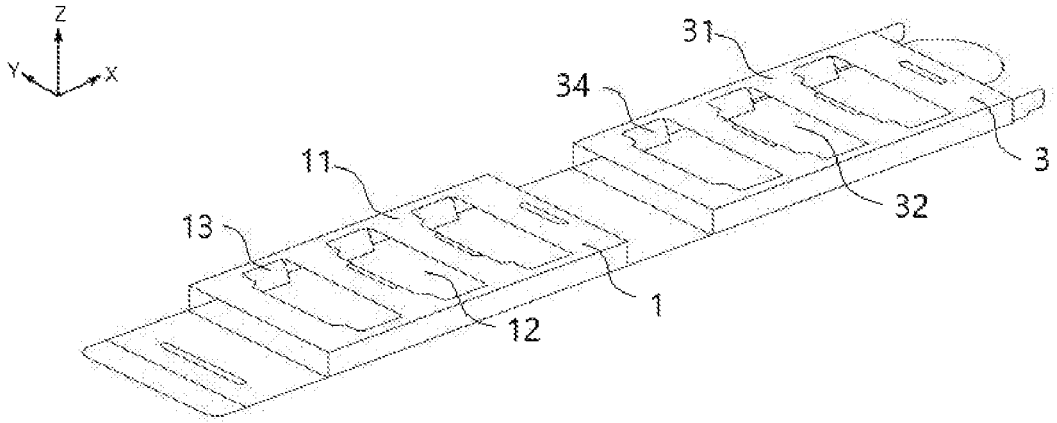
FIG. 4 is a schematic structural diagram of a first bending plate and a second bending plate in the packaging box shown in FIG. 1 after being bent.

In some embodiments, referring to FIGS. 3 and 4, the first surface 11 is provided with at least one first bending plate 13. The at least one first bending plate 13 is provided along an outer peripheral edge of the first accommodating portion 12, and is bendably connected with the first packaging box body 1. And/or, the second surface 31 is provided with at least one second bending plate 34. The at least one second bending plate 34 is provided along an outer peripheral edge of the second accommodating portion 32, and is bendably connected with the second packing box body 3.

The first surface 11 and the second surface 31 are two opposite surfaces of the first packaging box body 1 and the second packaging box body 3 respectively, and both are provided with openings through which specific positions of the first accommodating portion 12 and the second accommodating portion 32 are respectively defined. The first bending plate 13 and the second bending plate 34 are respectively arranged on the outer peripheral sides of the openings, and can be bent inwardly respectively relative to the first packaging box body 1 and the second packaging box body 3. Both the first bending plate 13 and the second bending plate 34 can be composed of multiple parts. Shapes and sizes of the openings on the first surface 11 and the second surface 31 can be respectively adjusted adaptively by a bend of different parts on the first bending plate 13 and the second bending plate 34. That is, the shape and size of the first accommodating portion 12 and the second accommodating portion 32 are adaptively changed to meet needs of accommodating products of different specifications and sizes. Specifically, when the product size is small, original dimensions of the first accommodating portion 12 and the second accommodating portion 32 can meet a load-bearing requirement, and the first bending plate 13 and the second bending plate 34 do not need to be bent. When the product size is large, different parts of the first bending plate 13 and the second bending plate 34 can be bent as needed, so that the product is compatible with the sizes of the first accommodating portion 12 and the second accommodating portion 32, and thus the versatility is strong.

In some embodiments, please continue to refer to FIG. 4, a length of the first bending plate 13 having been bent in the third direction Z is not greater than a thickness of the first packaging box body 1 in the third direction Z, and a second length of the bending plate 34 having been bent in the third direction Z is not greater than a thickness of the second packaging box body 3 in the third direction Z.

The third direction Z is the thickness direction of the first packaging box body 1. During bending, the first bending plate 13 is bent toward inside of the first packaging box body 1 to enlarge a size of the first accommodating portion 12, and the second bending plate 34 is bent toward inside of the second packaging box body 3 to enlarge a size of the second accommodating portion 32. The maximum bendable length of the first bending plate 13 in the third direction Z in the embodiment of the present disclosure specifically refers to the length of the bending plate 13 in the third direction Z when the first bending plate 13 is bent toward the inside of the first packaging box body 1 by 90°. At this time, the first bending plate 13 is perpendicular to the first surface 11 and its length is smaller than the thickness of the first packaging box body 1, so the first bending plate 13 can continue to be bent and thus an angle between the first bending plate 13 and the first surface 11 is greater than 90°. Thus the size of the first accommodating portion 12 is further enlarged to meet an accommodating need of large-sized products. The structure of the second bending plate 34 is similar to the structure of the first bending plate 13, which will not be described in detail in the present application.

Figure 12:
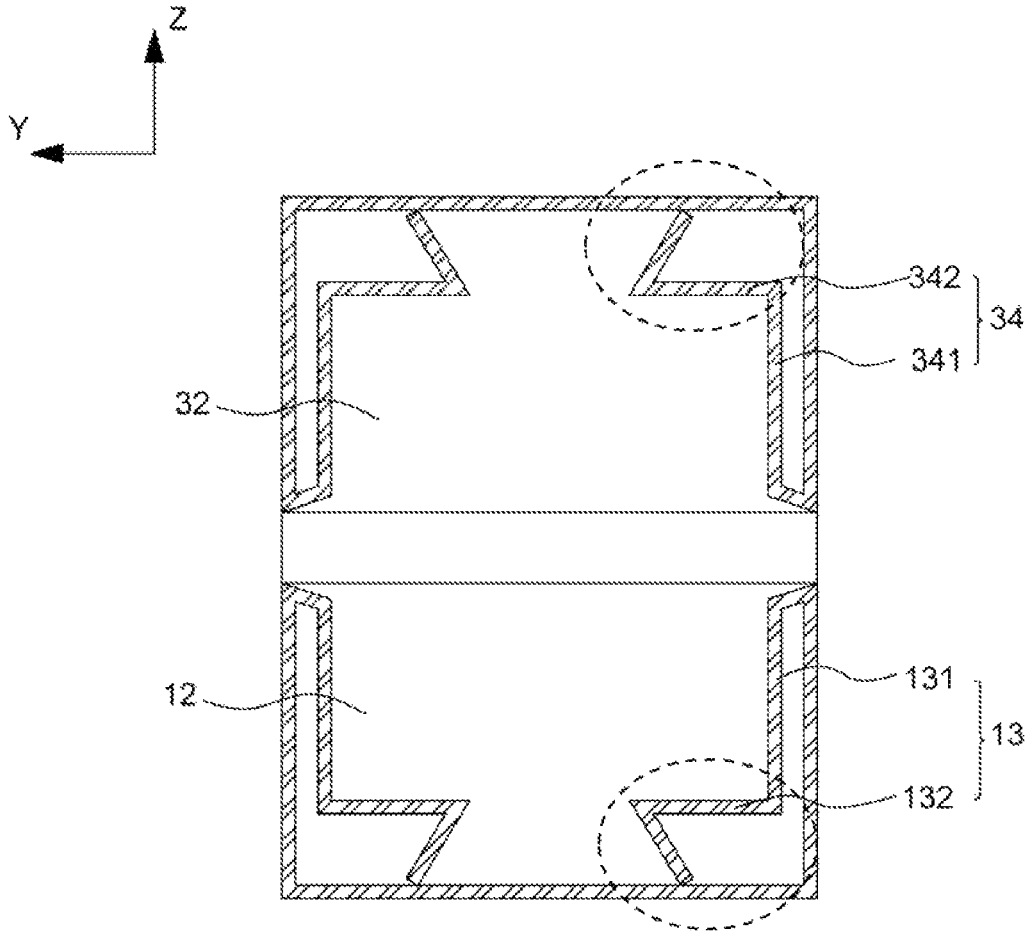
FIG. 12 is a schematic structural diagram of another paperboard structure provided by an embodiment of the present disclosure.

Referring to FIG. 12, in some embodiments, the first bending plate 13 includes a first connecting portion 131 and a first shock-absorbing portion 132. An end of the first connecting portion 131 is connected to an outer peripheral edge of the first accommodating portion 12, and the other end of the first connecting portion 131 is connected to the first shock-absorbing portion 132. And/or, the second bending plate 34 includes a second connecting portion 341 and a second shock-absorbing portion 342. An end of the second connecting portion 341 is connected to an outer peripheral edge of the second accommodating portion 32, and the other end of the second connecting portion 341 is connected to the second shock-absorbing portion 342.

The first connecting portion 131 and the first shock-absorbing portion 132 are formed by a bend of the first bending plate 13, and the second connecting portion 341 and the second shock-absorbing portion 342 are formed by a bend of the second bending plate 34. During use, both the first connecting portion 131 and the second connecting portion 341 extend along the third direction Z and are respectively located on a side of the product. A certain gap is formed between the first connecting portion 131 and a side wall of the packaging box 341 via the bend, and a certain gap is formed between the second connecting portion 341 and a side wall of the packaging box via the bend, so an outer periphery of the product can be protected. Both the first shock-absorbing portion 132 and the second shock-absorbing portion 342 extend parallel to the second direction Y, and are located at the top or bottom of the product, so as to protect upper and lower surfaces of the product. In addition, the first shock-absorbing portion 132 and the second shock-absorbing portion 342 can be formed by being bent several times, so as to have a certain elastic reset ability and have a shock-absorbing effect, thereby improving an ability to bear pressure of the product during movement.

In another aspect, an embodiment of the present disclosure provides a paperboard structure. FIG. 5 to FIG. 11 show schematic diagrams of a process of folding the paperboard structure to form a packaging box. Please refer to FIG. 5. The paperboard structure includes a first switchable connecting area S41, a first body area S1, an integral connecting area S2, and a second body area S3 are connected in sequence along the first direction X. The first body area S1 is used to form the first packaging box body 1. The integral connecting area S2 is used to form the integral connecting portion 2. The second body area S3 is used to form the second packaging box body 3. The first switchable connecting area S41 is used to form the first part 41.

When the paperboard structure is not bent, it has a plane structure, and is bent and pressed to form the packaging box. Two sides of the plane structure are respectively the first surface and the second surface. In order to facilitate the description of the bending process of the paperboard structure, the embodiment of the present disclosure is described in detail using the first surface and the second surface. When the paperboard structure is bent, it is bent toward the first surface. It means that an angle less than 180° is formed between the first surfaces of the two bent parts, and an angle greater than 180° is formed on the second surface. Correspondingly, bending toward the second surface means that an angle less than 180° is formed between the second surfaces of the two bent parts, and an angle greater than 180° is formed on the first surface, which will not be repeated in the present disclosure.

The first body area S1 includes a first bottom area S11, a first top area S12, and a first sidewall area S13 for connecting the first bottom area S11 and the first top area S12 distributed along the second direction Y. The first bottom area S11, the first top area S12, and the first sidewall area S13 are bendable connected, and the first top area S12 is provided with a first accommodating opening S121.

The second body area S3 and the first body area S1 are arranged opposite to the first body area S1 and are spaced apart in the third direction Z via the integral connecting area S2. The second body area S3 includes a second bottom area S31, and a second top area S32, and a second sidewall area S33 connecting the second bottom area S31 and the second top area S32 distributed along the second direction Y. The second bottom area S32, the second top area S32, and the second sidewall area S33 are bendable connected, and the second top area S32 is provided with a second accommodating opening S321.

Both the number of the first sidewall areas S13 and the number of the second sidewall areas S33 are set as two. The first sidewall areas S13 are respectively located on two sides of the first top area S12, and the second sidewall areas S33 are respectively located on two sides of the second top area S32, to play a supporting role. And the first bottom area S11, the first top area S12, and the first sidewall areas S13 can be bent and enclosed to form a cavity structure, and the second bottom area S31, the second top area S32, and the second sidewall areas S33 can also be bent and enclosed to form a cavity structure. The first accommodating opening S121 and the second accommodating opening S321 are used to respectively define positions of the first accommodating portion 12 and the second accommodating portion 32. It should be noted that the first body area S1 may also include a first bottom adhesive area S14 which is located on a side of the first top area S12 away from the first bottom area S11. The second body area S3 also includes a second bottom adhesive area S34 which is located on a side of the second top area S32 away from the second bottom area S31. The first bottom adhesive area S14 has the same size as the first bottom area S11, and the second bottom adhesive area S34 has the same size as the second bottom area S31. When being bent, the first bottom adhesive area S14 and the second bottom adhesive area S34 are respectively pressed and adhered to realize a shape fixation of the first packaging box body 1 and the second packaging box body 3.

Figure 5:
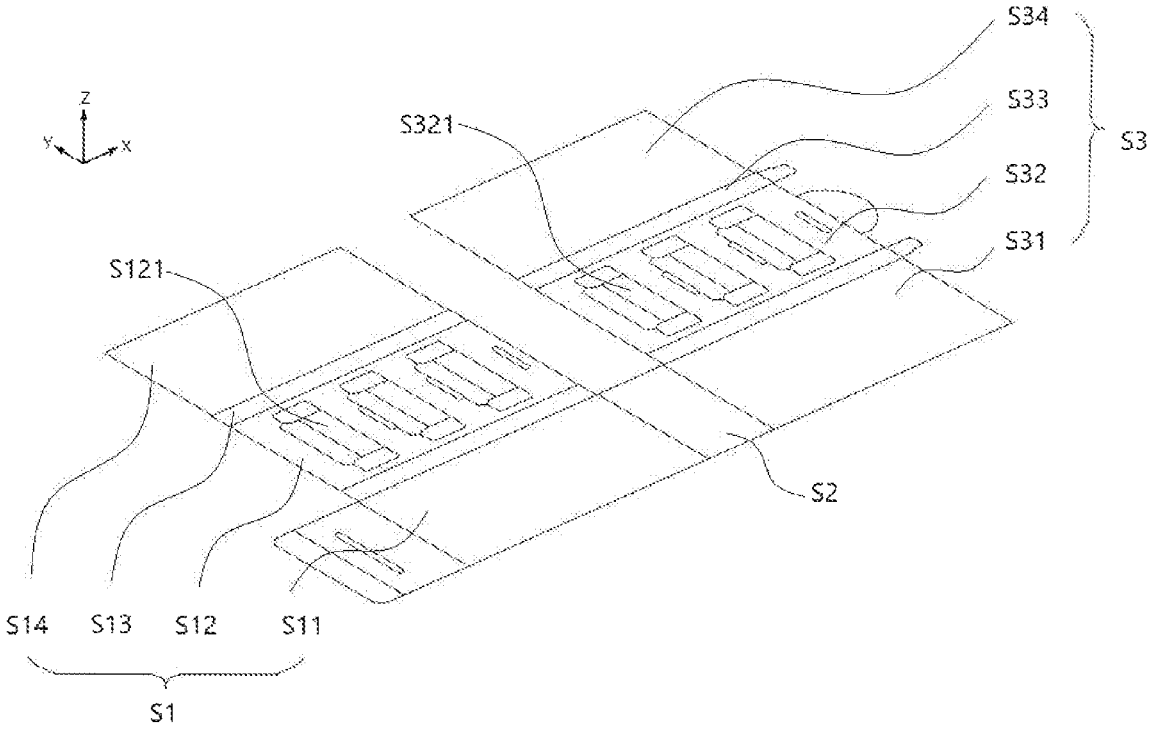
FIG. 5 is a schematic structural diagram of a paperboard structure provided by an embodiment of the present disclosure.
Figure 6:
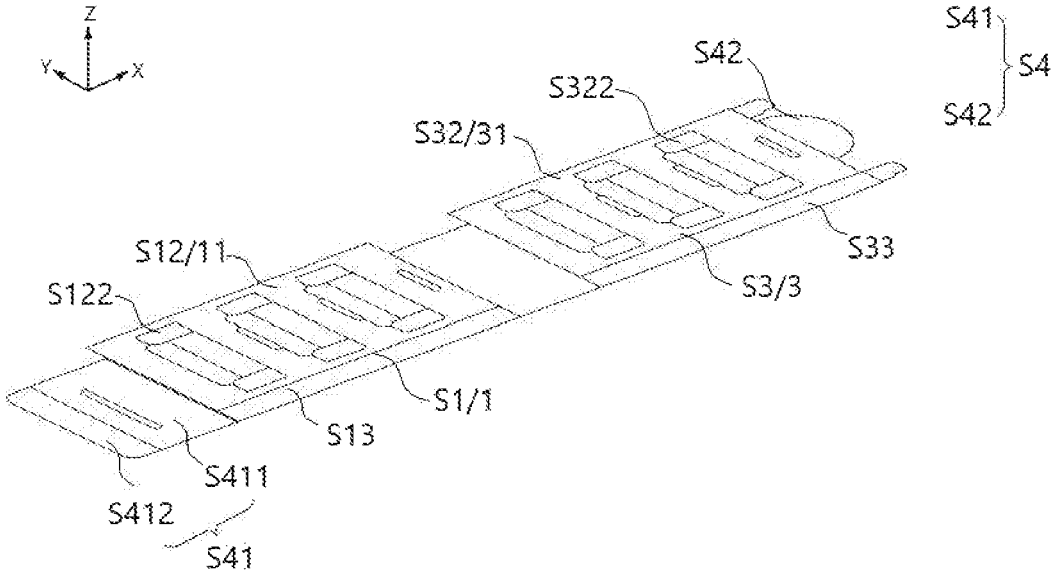
FIG. 6 is a schematic structural diagram of the paperboard structure shown in FIG. 5 after being bent.

Referring to FIGS. 5 and 6, during the bending process, the first body area S1 and the second body area S3 can be respectively bent to form the first packaging box body 1 and the second packaging box body 3. The first packaging box body 1 and the second packaging box body 3 are in a hollow three-dimensional structure. Taking the first body area S1 forming the first packaging box body 1 as an example, the first sidewall area S13 located between the first top area S12 and the first bottom area S11 is bent toward the first surface firstly, and then the first top area S12 is bent toward the second surface to form the first surface 11 disposed opposite to the first bottom area S11. The first sidewall area S13 on the side of the first top area S12 away from the first bottom area S11 is bent toward the second surface, and is in contact with the first bottom area S11. At this time, the first body area S1 is enclosed to form the first packaging box body 1.

The first packaging box body 1 enclosed by the first body area S1, the integral connecting area S2, the second packaging box body 3 enclosed by the second body area S3, and the first switchable connecting area are connected end to end in sequence to form the packaging box.

Figure 8:
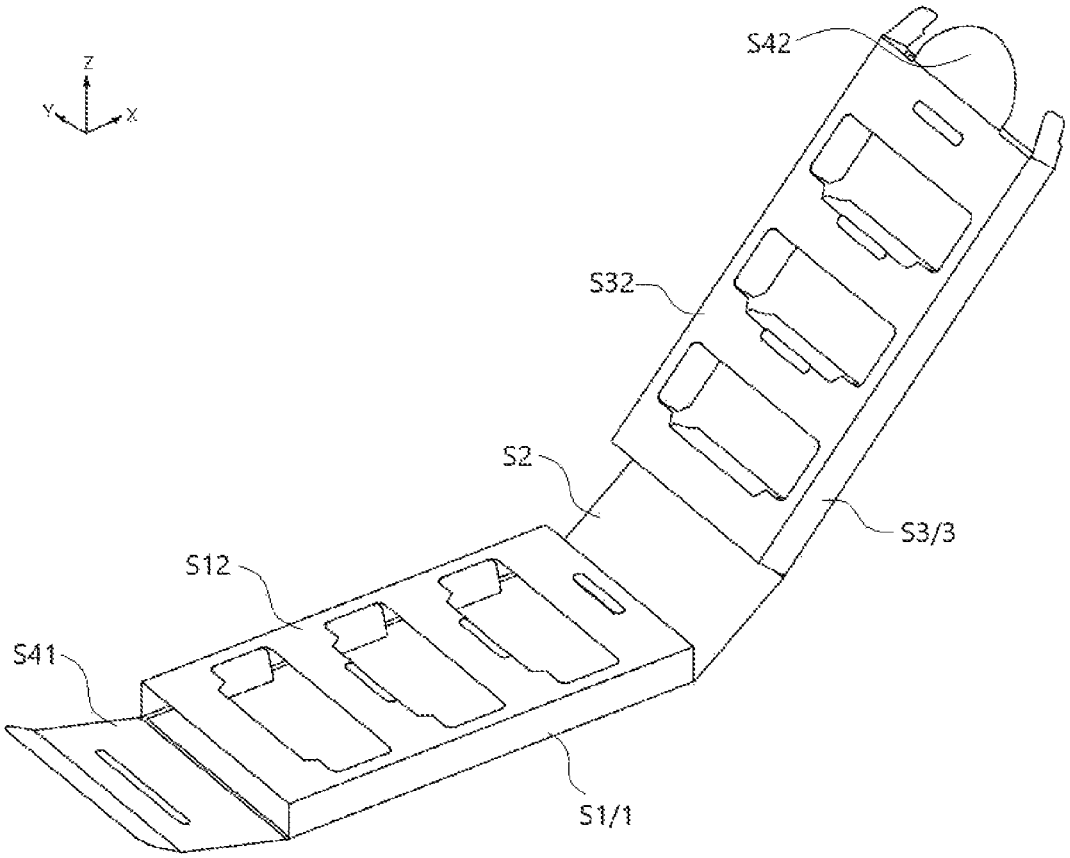
FIG. 8 is a schematic structural diagram of the paperboard structure shown in FIG. 7 after being further bent.
Figure 9:
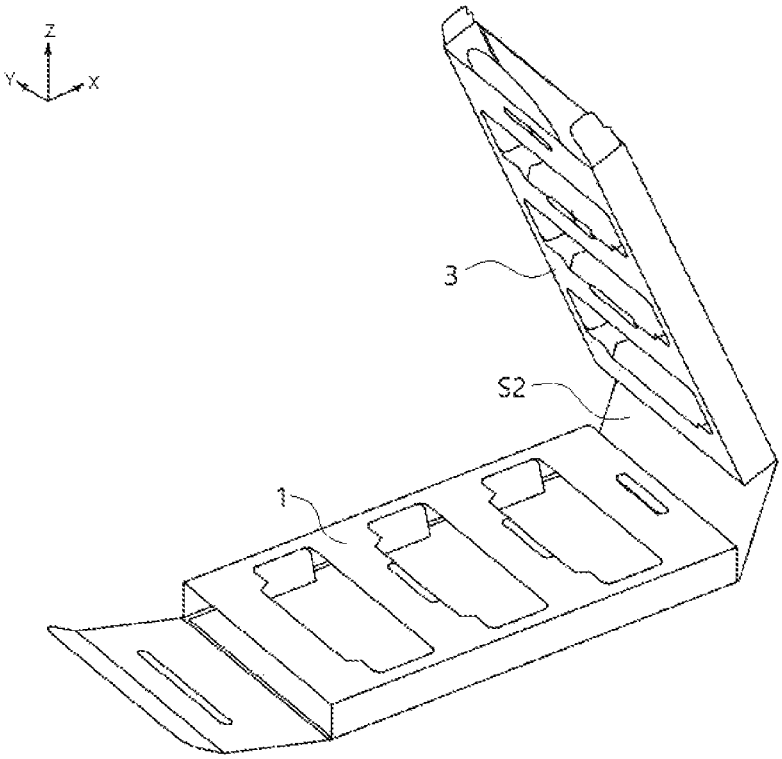
FIG. 9 is a schematic structural diagram of the paperboard structure shown in FIG. 8 after being further bent.
Figure 10:
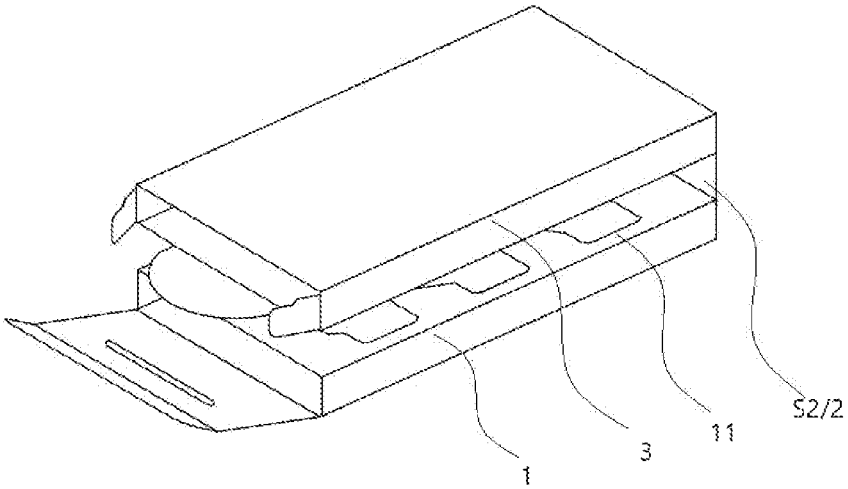
FIG. 10 is a schematic structural diagram of the paperboard structure shown in FIG. 9 after being further bent.
Figure 11:
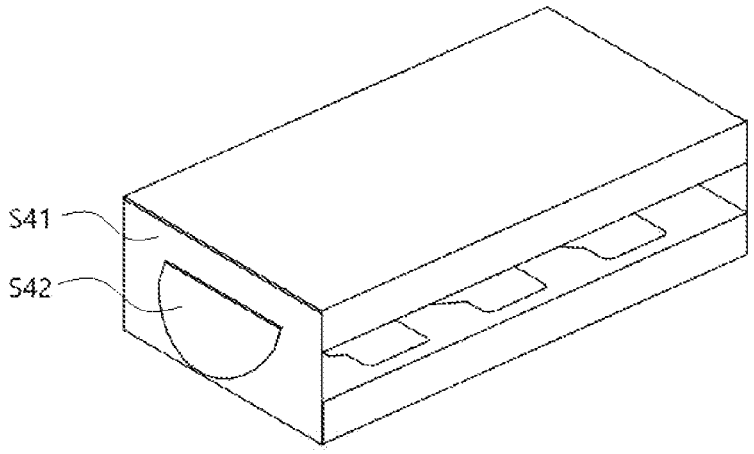
FIG. 11 is a schematic structural diagram of the paperboard structure shown in FIG. 10 after being further bent.

Specifically, referring to FIGS. 5 and 8 together, the integral connecting area S2 is located between the first body area S1 and the second body area S3 along the first direction X, and the first switchable connecting area S41 is located at a side of the first bottom area S11 away from the integral connecting area S2. When the first body area S1 and the second body area S3 are respectively bent to form the first packaging box body 1 and the second packaging box body 3, the second packaging box body 3 and the integral connecting area S2 are simultaneously bent toward the first side by an angle. As shown in FIGS. 9 and 10, the second packaging box body 3 is then bent toward the second surface, so that the first packaging box body 1 and the second packaging box body 3 are stacked in the third direction Z, and the integral connecting area S2 forms the integral connecting portion 2 arranged perpendicular to the first surface 11. As shown in FIG. 11, finally, the entire packaging box is assembled via a fit connection of the first switchable connecting area S41 and the second packaging box body 3. The entire bending process only relates a half fold and adhesive, so the assembly can be realized through automated production, thereby reducing manual operations and improving production efficiency of the packaging box.

In some embodiments, the paperboard structure further includes a second switchable connecting area S42. Both the first switchable connecting area S41 and the second switchable connecting area S42 are pluggable, and together form the switchable connecting area S4. The fit connection of the switchable connecting area S41 and the second switchable connecting area S42 can fix or separate the first packaging box body 1 and the second packaging box body 3.

The first switchable connecting area S41 is connected to the first body area S1, the second switchable connecting area S42 is connected to the second body area S2, and the first switchable connecting area S41 can be connected to the second packaging box body 3 in a pluggable manner in addition to the fit connection to the switchable connecting area S42. Specifically, the first switchable connecting area S41 includes a transition area S411 and a first switchable area S412. The first switchable area S412 is connected to the first body area S1 via the transition area S411, and the transition area S411 is provided with a second slot. area S4111 which is correspondingly fit to the second area S42. In use, the transition area S411 is bent toward the first surface to form the transition portion 411, and the first switchable area S412 is bent toward the second surface to form the first switchable portion 412. Since the second packaging box body 3 has a cavity structure, the first switchable portion 412 can be plugged into the second packaging box to form a first fixation. At this time, the second switchable connection area S42 is plugged into the second slot area S4111 at the same time to form a second fixation. In the embodiment of the present disclosure, the double fixation makes the entire packaging box stable and reliable, and capable of bearing a pressure In some embodiments, referring to FIG. 5, a length of the integral connecting area S2 in the first direction X is h1, a length of the first sidewall area S13 in the second direction Y is h2, and a length of the second sidewall area S33 in the second direction Y is h3, wherein $h1 \geq h2+h3$.

During the bending process, the integral connecting area S2 is used to form the integral connecting portion 2, the first sidewall area S13 is used to form the sidewall of the first packaging box body 1, and the second sidewall area S33 is used to form the sidewall of the second package box body 3. In the embodiment of the present disclosure, via $h1 \geq h2+h3$, the first packaging box body 1 and the second packaging box body 3 are spaced apart, and the opening space 5 is formed between them for accommodating larger-sized products to meet a need of different sizes and improve a versatility of the packaging box.

Figure 7:
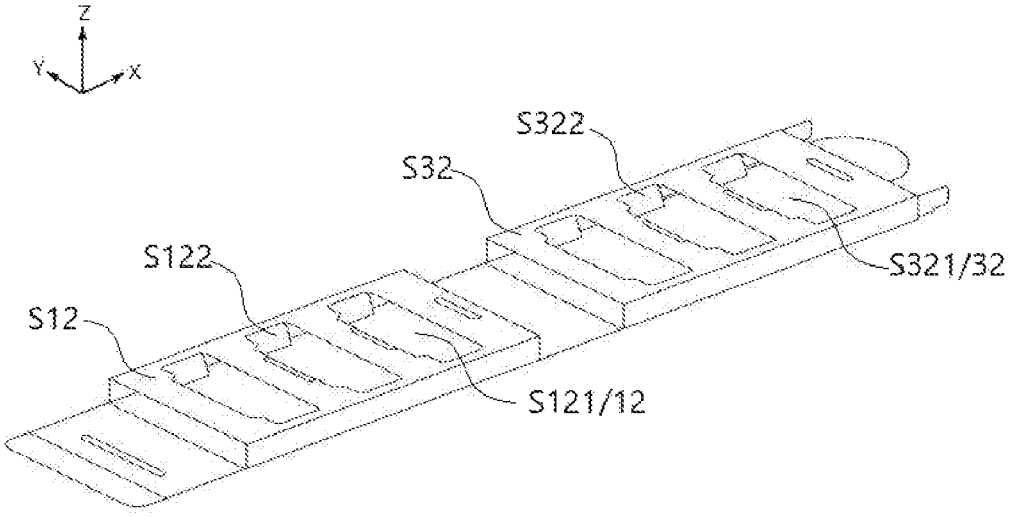
FIG. 7 is a schematic structural diagram of the paperboard structure shown in FIG. 6 after being further bent.

In some embodiments, referring to FIG. 7, the first top area S12 is provided with at least one first bending area S122. And at least one first bending area S122 is provided along an outer peripheral edge of the first accommodating opening S121, and the second top area S32 is provided with at least one second bending area S322. And at least one second bending area S322 is provided along an outer peripheral edge of the second accommodating opening S321.

The first bending area S122 and the first top area S12 are bendably connected, and the second bending area S322 and the second top area S32 are bendably connected. It can be seen from the above content that the first accommodating opening S121 and the second accommodating opening S321 are used to define the first accommodating portion 12 and the second accommodating portion 32. The first bending area S122 and the second bending area S322 can respectively increase sizes of the first accommodating opening S121 and the second accommodating opening S321, thus respectively increase sizes of the first accommodating portion 12 and the second accommodating portion 32 to meet installation requirements of products of different sizes.

Therefore, embodiments of the present disclosure provide a packaging box and a paperboard structure. The paperboard structure has a plane structure, and can be only bent and adhered to form a three-dimensional packaging box, which meets a need of automated production and helps improve production efficiency. One packaging box can carry multiple products at the same time, with high space utilization and strong versatility. In addition, compared with traditional blister packages, this packaging box adopts a paper card structure, which can be fully degraded, adapts to environmental protection trends, and is beneficial to reducing carbon emissions and protecting the environment.

Optional, the first surface and the second surface are positioned to be opposite to each other and are separated by a predetermined distance; and/or, both the first accommodating portions and the second accommodating portions are set as multiple, and multiple the first accommodating portions and multiple the second accommodating portions are arranged in a one-to-one correspondence.

Optional, an end of the second packaging box body close to the switchable connecting portion is provided with a first slot, the switchable connecting portion comprises a first part connected to the first packaging box body, the first part comprises a transition portion and a first switchable portion, and the first switchable portion is bendably connected to the first packaging box body via the transition portion, and is arranged in the first slot in a pluggable manner; and/or, the switchable connecting portion further comprises a second part connected to the second packaging box body, the second part is provided on the second surface, the transition portion of the first part is provided with a second slot, and the second part is arranged in the second slot in a pluggable manner.

Optional, the first surface is provided with at least one first bending plate. And at least one first bending plate is provided along an outer peripheral edge of the first accommodating portion and bendably connected with the first packaging box body; and/or, the second surface is provided with at least one second bending plate. And at least one second bending plate is provided along an outer peripheral edge of the second accommodating portion and bendably connected to the second packaging box body.

Optional, a length of the first bending plate having been bent in a third direction is not greater than a thickness of the first packaging box body in the third direction; and/or, a length of the second bending plate having been bent in the third direction is not greater than a thickness of the second packaging box body in the third direction.

Optional, the first bending plate comprises a first connecting portion and a first shock-absorbing portion, an end of the first connecting portion is connected to an outer peripheral edge of the first accommodating portion, and the other end of the first connecting portion is connected to the first shock-absorbing portion; and/or, the second bending plate comprises a second connecting portion and a second shock-absorbing portion, an end of the second connecting portion is connected to an outer peripheral edge of the second accommodating portion, and the other end of the second connecting portion is connected to the second shock-absorbing portion.

Optional, the paperboard structure further comprises a second switchable connecting area, wherein the second switchable connecting area is connected with the first switchable connecting area in a pluggable manner, so as to fix or separate the first packaging box body and the second packaging box body, and wherein the first switchable connecting area comprises a transition area and a first switchable area, the first switchable area is connected to the first body area via the transition area, the transition area is provided with a second slot area corresponding to and fitting with the second switchable connecting area.

Optional, a length of the integral connecting area in the first direction is h1, a length of the first sidewall area in the second direction is h2, a length of the second sidewall area in the second direction is h3, wherein $h1 \geq h2+h3$.

Optional, the first top area is provided with at least one first bending area. And at least one first bending area is provided along an outer peripheral edge of the first accommodating opening; the second top area is provided with at least one second bending area. And least one second bending area is provided along an outer peripheral edge of the second accommodating opening.

In the packaging box and the paperboard structure of embodiments of the present disclosure, the first packaging box body and the second packaging box body are stacked in the third direction, form the first accommodating portion and the second accommodating portion along the thickness direction of the packaging box to support and protect a product without additional inner snapping structure, and the overall structure is stable and reliable. And according to different actual situations, the first accommodating portion and the second accommodating portion can be designed into different shapes and sizes, so as to carry products of different sizes, and meet a need to use different types of products. In addition, the bendable connection is formed between the first packaging box body and the second packaging box body form via the integral connecting portion and the switchable connecting portion, and the packaging box can be opened or closed by a plug in or plug out of the switchable connecting portion during use, which is convenient for products to be put in and taken out to be completely displayed.

The above descriptions are only preferred embodiments of the present disclosure, and are not intended to limit the present application. For those skilled in the art, the embodiments of the present disclosure may have various modifications and changes. Any modification, equivalent replacement, improvement, etc. made within concepts and principles of the present application shall be included in the scope of protection of the present disclosure.

Those skilled in the art should understand that the above-mentioned embodiments are all illustrative and not restrictive. Different technical features appearing in different embodiments can be combined to achieve beneficial effects. Those skilled in the art should be able to understand and implement other modified embodiments of the disclosed embodiments on the basis of studying the drawings, description, and claims. In the claims, the term "comprising" does not exclude other means or steps; when an article is not modified by a quantitative word, it is intended to include one/one kind or multiple/multiple kinds of articles, and can be interchanged with "one/one kind or multiple/multiple kinds of articles"; the terms "first" and "second" are used to indicate names rather than to indicate any specific order. Any reference signs in the claims should not be construed as limiting the scope of protection. Functions of multiple parts appearing in the claims can be realized by a single hardware or software module. Certain technical features in different dependent claims does not mean that these technical features cannot be combined to achieve beneficial effects.

What is claimed is:

1. A packaging box, comprising a first packaging box body, an integral connecting portion, a second packaging box body and a switchable connecting portion which are connected end to end in sequence;

wherein the first packaging box body comprises a first accommodating portion formed by a first surface in a thickness direction of the first packaging box body recessed inwardly;

the second packaging box body comprises a second accommodating portion formed by a second surface in a thickness direction of the second packaging box body recessed inwardly; and a bendable connection is formed between the first packaging box body and the second packaging box body via the integral connecting portion and the switchable connecting portion, so that the first surface and the second surface are positioned to be opposite to each other, the first surface is provided with at least one first bending plate provided along an outer peripheral edge of the first accommodating portion and bendably connected with the first packaging box body, the first bending plate comprises a first connecting portion and a first shock-absorbing portion with an elastic reset ability, an end of the first connecting portion is connected to an outer peripheral edge of the first accommodating portion, the other end of the first connecting portion is connected to the first shock-absorbing portion, different sections of the first bending plate are used to form the first connecting portion and the first shock-absorbing portion respectively, and the first connecting portion and the first shock-absorbing portion are formed by the different sections of the first bending plate bent relative to each other; and/or, the second surface is provided with at least one second bending plate provided along an outer peripheral edge of the second accommodating portion and bendably connected to the second packaging box body, the second bending plate comprises a second connecting portion and a second shock-absorbing portion with an elastic reset ability, an end of the second connecting portion is connected to an outer peripheral edge of the second accommodating portion, the other end of the second connecting portion is connected to the second shock-absorbing portion, different sections of the second bending plate are used to form the second connecting portion and the second shock-absorbing portion respectively, and the second connecting portion and the second shock-absorbing portion are formed by the different sections of the second bending plate bent relative to each other.

2. The packaging box according to claim 1, wherein the first surface and the second surface are positioned to be opposite to each other and are separated by a predetermined distance; and/or, numbers of both the first accommodating portions and the second accommodating portions are set as multiple, and the multiple first accommodating portions and the multiple second accommodating portions are arranged in a one-to-one correspondence.

3. The packaging box according to claim 1, wherein:

an end of the second packaging box body close to the switchable connecting portion is provided with a first slot, the switchable connecting portion comprises a first part connected to the first packaging box body, the first part comprises a transition portion and a first switchable portion, and the first switchable portion is bendably connected to the first packaging box body via the transition portion, and is arranged in the first slot in a pluggable manner; and/or, the switchable connecting portion further comprises a second part connected to the second packaging box body, the second part is provided on the second surface, the transition portion of the first part is provided with a second slot, and the second part is arranged in the second slot in a pluggable manner.

4. The packaging box according to claim 1, wherein a length of the first bending plate having been bent in a third direction is not greater than a thickness of the first packaging box body in the third direction; and/or, a length of the second bending plate having been bent in the third direction is not greater than a thickness of the second packaging box body in the third direction.

5. A paperboard structure comprising a first switchable connecting area, a first body area, an integral connecting area, and a second body area connected in sequence along a first direction;

wherein the first body area is used to form a first packaging box body, and comprises a first bottom area, a first top area, and a first sidewall area that connects the first bottom area and the first top area distributed along a second direction, and wherein the first top area is provided with a first accommodating opening;

the second body area is used to form a second packaging box body, and comprises a second bottom area, a second top area and a second sidewall area that connects the second bottom area and the second top area distributed along the second direction, and wherein the second top area is provided with a second accommodating opening;

the first switchable connecting area is used to connect the first body area and the second body area to form a packaging box;

wherein the packaging box comprises the first packaging box body, the integral connecting area, the second packaging box body, and the first switchable connecting area that are connected end to end in sequence;

wherein the first direction intersects the second direction, at least one first bending plate is provided along an outer peripheral edge of the first accommodating opening and bendably connected with the first packaging box body, the first bending plate comprises a first connecting portion and a first shock-absorbing portion with an elastic reset ability, an end of the first connecting portion is connected to an outer peripheral edge of the first accommodating opening, the other end of the first connecting portion is connected to the first shock-absorbing portion, different sections of the first bending plate are used to form the first connecting portion and the first shock-absorbing portion respectively, and the first connecting portion and the first shock-absorbing portion are formed by the different sections of the first bending plate bent relative to each other; and/or, at least one second bending plate is provided along an outer peripheral edge of the second accommodating opening and bendably connected to the second packaging box body, the second bending plate comprises a second connecting portion and a second shock-absorbing portion with an elastic reset ability, an end of the second connecting portion is connected to an outer peripheral edge of the second accommodating opening, the other end of the second connecting portion is connected to the second shock-absorbing portion, different sections of the second bending plate are used to form the second connecting portion and the second shock-absorbing portion respectively, and the second connecting portion and the second shock-absorbing portion are formed by the different sections of the second bending plate bent relative to each other.

6. The paperboard structure according to claim 5, further comprising a second switchable connecting area, wherein the second switchable connecting area is connected with the first switchable connecting area in a pluggable manner, so as to fix or separate the first packaging box body and the second packaging box body, and wherein the first switchable connecting area comprises a transition area and a first switchable area, the first switchable area is connected to the first body area via the transition area, the transition area is provided with a second slot area corresponding to and fitting with the second switchable connecting area.

7. The paperboard structure according to claim 5, wherein a length of the integral connecting area in the first direction is h1, a length of the first sidewall area in the second direction is h2, a length of the second sidewall area in the second direction is h3, wherein h1≥h2+h3.

8. The paperboard structure according to claim 5, wherein the first top area is provided with at least one first bending area provided along an outer peripheral edge of the first accommodating opening;

the second top area is provided with at least one second bending area provided along an outer peripheral edge of the second accommodating opening.

* * * * *